US005571343A

United States Patent [19]

Ryoo et al.

[11] Patent Number: 5,571,343

[45] Date of Patent: Nov. 5, 1996

[54] AUSTENITIC STAINLESS STEEL HAVING SUPERIOR PRESS-FORMABILITY, HOT WORKABILITY AND HIGH TEMPERATURE OXIDATION RESISTANCE, AND MANUFACTURING PROCESS THEREFOR

[75] Inventors: Do Y. Ryoo; Yong H. Lee; Jae S. Park; Hyun C. Kim; Eung J. Kim, all of Pohang, Rep. of Korea

[73] Assignees: Pohang Iron & Steel Co., Ltd.; Research Institute of Industrial Science & Technology, both of Kyong Sang Book-Do, Rep. of Korea

[21] Appl. No.: 416,875

[22] Filed: Apr. 19, 1995

[30] Foreign Application Priority Data

Aug. 25, 1993 [KR] Rep. of Korea ..... 1993/16607

[51] Int. Cl.[6] ..... C22C 38/40; C21D 8/00

[52] U.S. Cl. ..... 148/325; 148/610

[58] Field of Search ..... 148/325, 610

[56] References Cited

U.S. PATENT DOCUMENTS

| | | |
|---|---|---|
| 3,282,684 | 11/1966 | Allen . |
| 4,265,679 | 5/1981 | Ohashi et al. . |
| 4,849,166 | 7/1989 | Hoshino et al. . |

FOREIGN PATENT DOCUMENTS

| | | | |
|---|---|---|---|
| 840933 | 5/1970 | Canada . | |
| 1302975 | 2/1971 | Germany . | |
| 43-008343 | 3/1943 | Japan . | |
| 52-119414 | 10/1977 | Japan . | |
| 52-117227 | 10/1977 | Japan . | |
| 54-138811 | 10/1979 | Japan . | |
| 54-128919 | 10/1979 | Japan . | |
| 57-016152 | 1/1982 | Japan . | |
| 59-23824 | 2/1984 | Japan | 148/610 |
| 1092342 | 4/1989 | Japan . | |

*Primary Examiner*—Deborah Yee

*Attorney, Agent, or Firm*—Webb Ziesenheim Bruening Logsdon Orkin & Hanson P.C.

[57] ABSTRACT

An austenitic stainless steel and a manufacturing process therefor are disclosed, in which, instead of the expensive Ni, there are added Cu as an austenite (τ) stabilizing element, and tiny amounts of Ti as a ferrite forming element and B for improvement of high temperature hot workability, so that the optimum $Md_{30}$temperature and the optimum delta-ferrite content can be controlled, thereby improving the formability, the season cracking resistance, the hot workability and the high temperature oxidation resistance, and reducing the surface defects during the hot rolling and saving the manufacturing cost by reducing the content of Ni. The austenitic stainless steel according to the present invention includes in weight %: less than 0.07% of C, less than 1.0% of Si, less than 2.0% of Mn, 16–18% of Cr, 6.0–8.0% of Ni, less than 0.005% of Al, less than 0.05% of P, less than 0.005% of S, less than 0.03% of Ti, less than 0.003% of B, less than 3.0% of Cu, less than 0.3% of Mo, less than 0.1% of Nb, less than 0.045% of N, the balance of Fe, and other indispensable impurities. Thus the present invention improves the press formability, the season cracking resistance, the hot workability, and the high temperature oxidation resistance.

9 Claims, 6 Drawing Sheets

AUSTENITIC STAINLESS STEEL HAVING SUPERIOR PRESS-FORMABILITY, HOT WORKABILITY AND HIGH TEMPERATURE OXIDATION RESISTANCE, AND MANUFACTURING PROCESS THEREFOR

FIELD OF THE INVENTION

The present invention relates to an austenitic stainless steel having superior press-formability, hot workability and high temperature oxidation resistance, and a manufacturing process therefor.

BACKGROUND OF THE INVENTION

Generally the austenitic steel which is expressed by 18% Cr–8% Ni (STS 304) is superior in the formability, corrosion resistance and weldability compared with the ferritic stainless steel, and therefore, the austenitic stainless steel is widely used for press-forming purposes.

However, the austenitic stainless steel contains a large amount of the expensive element Ni, and therefore, its cost is very high.

Therefore, attempts have been made to manufacture a high formability stainless steel with the content of Ni reduced.

One of such attempts is Japanese Patent Publication No. Sho-43-8343 in which the proposed stainless steel contains less than 0.15% of C, 5.5–8.0% of Ni, 16–19% of Cr, 0.5–3.5% of Cu, and 0.04–0.1% of N.

However, in the case of the above stainless steel, the ingredient ranges are too wide, and therefore, the formability and other properties show much deviations. Further, the contents of C and N are too high, and therefore, the season cracking resistance is unsatisfactory. Particularly, the addition of Cu aggravates the hot workability.

Further, another proposal is disclosed in Japanese Patent Laid-open No. Sho-52-119414 and Sho-54-128919, in which Cu is added, and the content of Mn is raised by 2% in place of Ni. In this case, The content of Mn is too high, and therefore, the high temperature oxidation resistance is lowered, so that surface defects may occur due to a high temperature oxidation during the hot rolling of the slab. Further, when manufacturing a bright annealing sheet, blue color may occur during the bright annealing.

Still another attempt is seen in Japanese Patent Publication No. Sho-59-33663, in which the stainless steel containing Cu is made to contain less than 1% of an ingredient selected from a group consisting of Nb, Ti and Ta, so that the crystalline grains would become fine, thereby improving the formability of the stainless steel.

In this case, however, the content of C is too high, and therefore, the season cracking resistance is lowered.

Still another attempt is seen in Japanese Patent Laid-open No. Sho-54-13811, in which 0.005–1.0% of Nb is added to a steel containing extremely low levels of C and N. Thus the crystalline grains are made fine, and the austenitic phase is reinforced, so that the stretch ability would be improved.

In this case, however, due to the extremely low level of C and N, the refining work lowers the productivity, and the austenite equivalence is low, with the result that the content of the delta-ferrite is increased, thereby aggravating the hot workability.

Still another attempt is seen in Japanese Patent Laid-open No. Hei-1-92342 and German Patent Publication No. 302975. In the case of the former, a steel containing Cu is made to contain tiny amounts of Ti and B, and less than 50 ppm of oxygen, and less than 0.006% of Ca. Thus the formation of inclusion is inhibited, thereby improving the formability. In the case of the German patent, a steel containing Cu and B is made to contain one element or two selected from the group consisting of Nb, V, Ti and Zr by less than 0.15%. Thus the corrosion resistance, creep strength and the formability are improved. However, in these two inventions, the content of Ni is as high as 8%, and the high content of Ni makes the steel uneconomical.

There is still another attempt disclosed in Japanese Patent Publication No. Sho-55-89568, in which the steel contains 6–9% of Ni, 16–19% of Cr, less than 3% of Cu and 0.5–3.0% of Al, and further contains two elements selected from a group consisting of Nb, Ti, V, Zr and Ta by 0.2–1.0%, thereby improving the formability of the steel. In this case, however, the formation of an inclusion oxide material becomes very high due to the high content of Al, with the result that surface defects such as linear defect, sliver and the like occur on the hot rolled coil.

SUMMARY OF THE INVENTION

The present inventor made study and experiments to overcome the disadvantages of the conventional techniques, and came to propose the present invention.

Therefore it is the object of the present invention to provide an austenitic stainless steel and a manufacturing process therefor, in which, instead of the expensive Ni, there are added Cu as an austenite ($\tau$) stabilizing element, tiny amounts of Ti as a ferrite forming element, and B for improvement of high temperature hot workability, so that the optimum $Md_{30}$ temperature and the optimum delta-ferrite content can be controlled, thereby improving the formability, the season cracking resistance, the hot workability and the high temperature oxidation resistance, and reducing the surface defects during the hot rolling and saving the manufacturing cost by reducing the content of Ni.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
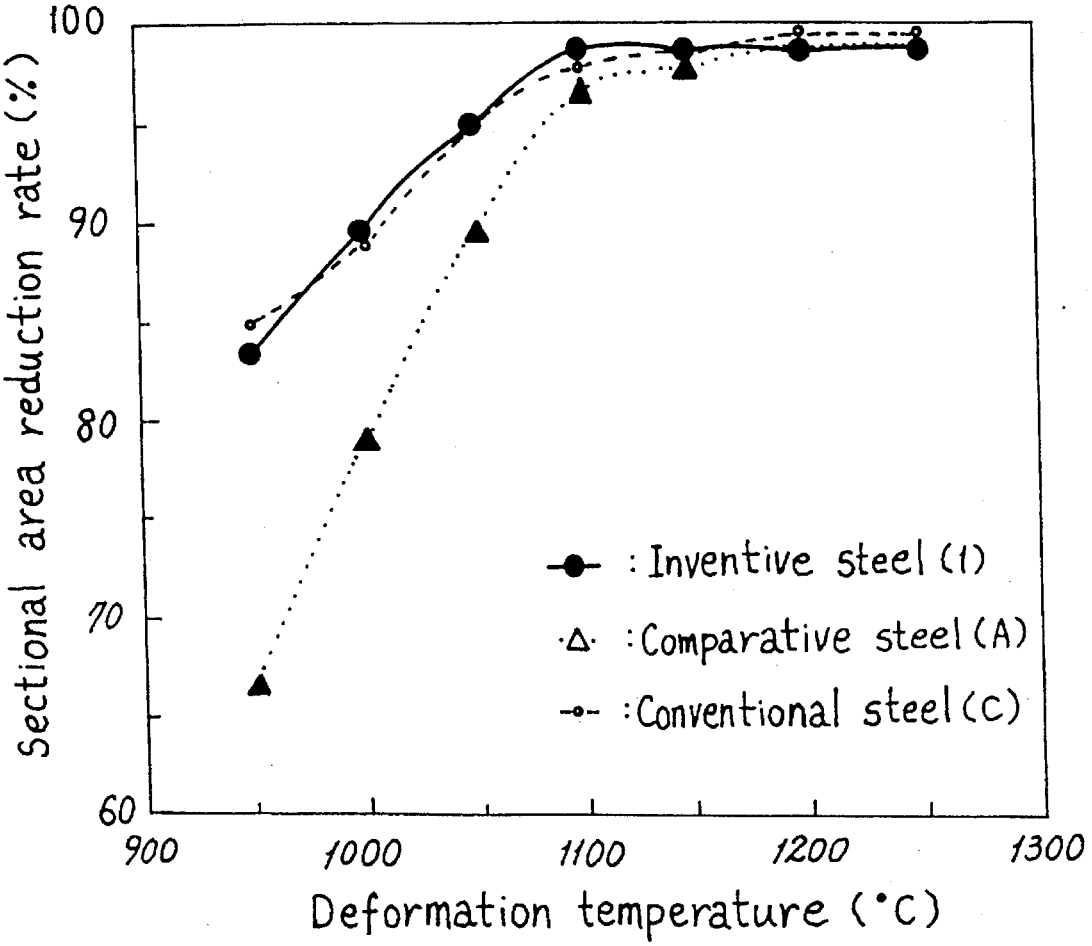
FIG. 1 is a graphical illustration showing the reduction of the sectional area versus the variation of deformation temperatures.

The austenitic stainless steel according to the present invention includes in weight %: less than 0.07% of C, less than 1.0% of Si, less than 2.0% of Mn, 16–18% of Cr, 6.0–8.0% of Ni, less than 0.005% of Al, less than 0.05% of P, less than 0.005% of S, less than 0.03% of Ti, less than 0.003% of B, less than 3.0% of Cu, less than 0.3% of Mo, less than 0.1% of Nb, less than 0.045% of N, the balance of Fe, and other indispensable impurities. The present invention also provides a process for manufacturing the austenitic stainless steel, and the austenitic stainless steel according to the present invention is superior in the press formability, the season cracking resistance, the hot workability and the high temperature oxidation resistance.

The stabilizing temperature [$Md_{30}$ (°C.)] for the austenitic phase is defined by [$Md_{30}$(°C.)=551–462 (C %+N %)–9.2 (Si %)–8.1 (Mn %)–29 (Ni %+Cu %)–13.8 (Cr %)–18.5 (Mo %)–68 (Nb %)–1.42 (ASTM grain number—8.0)]. It is desirable that this stabilizing temperature [$Md_{30}$(°C.)] is limited to −10° to +15° C., and that the content of the delta-ferrite within the steel slab or ingot is limited to 9.0 vol %.

Now the ingredients and the limits of the ranges of the ingredients will be described.

The ingredient C is a stabilizing element for a strong austenitic phase, and, during the casting of a slab or ingot (to be called "slab" below), C lowers the content of the delta-ferritic phase, thereby improving the hot workability. Further, C gives an effect of reducing the contents of expensive Ni, and increases the stacking fault energy, thereby improving the formability. If its content is too high, the strain-induced martensite strength is increased during the deep-drawing process, and the residue stress becomes high, with the result that the season cracking resistance is decreased. Further, during the annealing, the decrease of the corrosion resistance due to the carbide precipitation is apprehended. Therefore, the content of C should be desirably limited to less than 0.07%.

The ingredient Si is advantageous for the high temperature oxidation resistance, but, if its content is too high, the content of the delta-ferrite is increased, with the result that the hot workability is decreased. Further, the Si inclusions are increased, so that the formation of the inclusion-induced sliver would be apprehended. Therefore, the content of Si should be preferably limited to less than 1.0%.

As to the ingredient Mn, if its content is too high, the high temperature oxidation resistance is deteriorated. Particularly, during the bright annealing, a brightness defect in the form of blue color is apprehended. Therefore, the content of Mn should be preferably less than 2.0%.

If the content of the ingredient Cr is too low, then the corrosion resistance and the high temperature oxidation resistance are decreased. If its content is too high, then the content of the delta-ferrite is increased, with the result that the hot workability and the formability are decreased. Therefore, in order to obtain a corrosion resistance and a high temperature oxidation resistance equivalent to those of STS 304, the content of Cr should be preferably limited to 16.0–18.0%.

The content of Ni is adjusted by taking into account the stability of the austenitic phase, the formability, the season cracking resistance and the manufacturing cost. If its content is too high, the $Md_{30}$ temperature becomes too low, so that the stretchability would be decreased, as well as increasing the manufacturing cost. If its content is too low, the formation of the strain-induced martensitic phase is increased, with the result that the season cracking resistance is decreased. Therefore, the content of Ni should be preferably limited to 6.0–8.0%.

The ingredient Al is for improving the high temperature oxidation resistance. The higher its content, the more the inclusions due to Al oxides are increased, thereby increasing the surface defects and aggravating the formability. Therefore, its content should be preferably limited to less than 0.005%.

The ingredient Cu softens the steel, increases the stacking fault energy, and raises the stability of the austenitic phase. Therefore, Cu can be used in place of Ni, and if its content is more than 3.0%, then the formability is decreased, and the low melting point Cu is segregated on the boundary of the grains during the casting of the slab, so that cracks would be apprehended during the hot rolling. Therefore, its content should be preferably limited to less than 3.0%.

If the content of P is too high, the formability and the corrosion resistance are aggravated, and therefore, its content should be preferably limited to less than 0.05%.

The ingredient S lowers the hot rollability, and particularly, is segregated on the grain boundary of the austenitic phase during the solidification, so that slivers would be formed during the hot rolling. Therefore its content should be preferably limited to less than 0.005%.

The ingredient Ti serves the role of preventing the surface defects during the hot rolling by preventing the high temperature corrosion during the heating of the slab. Further it inhibits the formation of an orange peel by making the grains fine. Further if a steel contains a tiny amount of Ti which stabilizes the ferrite at the same stabilizing temperature $Md_{30}$, the formation of a strain-induced martensitic phase is increased during the press-forming compared with a steel without containing Ti. Consequently, the rupture strength and the work hardening exponent n of the high strain region are increased, so that the formability would be improved. If the content of Ti is too high, surface defects due to Ti oxides are caused, and therefore, the content of Ti should be preferably limited to 0.03%.

The ingredient B gives the effect of improving the hot workability, and therefore it is effective in preventing the surface defects caused during the hot workability. However, if its content is too high, it produces B compounds, so that the melting point of the steel would be significantly decreased, thereby aggravating the hot workability. Therefore, the content of B should be preferably limited to less than 0.003%.

If the content of N is high, it helps reduce the delta-ferrite, but it gives the effect of raising the yield strength of the steel by twice the effect of C, so that the formability would be aggravated. Further, due to the rise in the hardness and strengths, the season cracking resistance is decreased, and therefore, the content of N should be preferably limited to less than 0.045%.

The ingredients Mo and Nb are contained for an unavoidable reason, and therefore, it will be better, the less they are contained. In the present invention, the contents of Mo and Nb should be preferably limited to 0.3% and 0.1% respectively.

Now the reasons for determination of the stabilizing temperature ($Md_{30}$) for the austenitic phase and the content of the delta-ferrite, which are metallurgical factors, will be described.

If $Md_{30}$ (°C.) which represents the stability of the austenitic phase is high, the strain-induced martensitic phase is produced very much during the press-forming. Therefore, if the formability is to be improved, the $Md_{30}$ temperature should be controlled to the optimum level.

If the $Md_{30}$temperature for a steel containing Cu is too low, the formability is decreased. Then the content of the expensive Ni should be raised, and therefore, the manufacturing cost is increased. If the $Md_{30}$temperature is too high, the formability is not only aggravated, but also the season cracking resistance is aggravated, with the result that the season cracks are formed after the press-forming.

Therefore, if superior formability and season cracking resistance are to be obtained, the $Md_{30}$temperature should be preferably limited to −10° to +15 (°C.).

Meanwhile, if the content of the delta-ferrite is increased within a slab, then the hot workability is decreased, with the result that surface defects are generated during the manufacturing of the hot rolled steel sheet. Further, in manufacturing a cold rolled steel sheet, if the content of the delta-ferrite becomes high, the yield strength is increased, so that the formability would be decreased. Therefore the adjustment of the content of the delta-ferrite to the optimum level is important.

In the present invention, the content of the delta-ferrite should be preferably limited to less than 9.0 vol %.

The content (vol %) of the delta-ferrite within the slab is expressed by: [{(Cr %+Mo %+1.5 Si %+0.5 Nb %+18)/(Ni %+0.52 Cu %+30 C %+30 N %+0.5 Mn %+360}+0.262]× 161−161.

The austenitic stainless steel of the present invention is manufactured with the same process as that of the STS 304 steel, i.e., through a hot rolling of a slab, an annealing of the hot rolled steel sheet, an acid pickling, a cold rolling, an annealing of the cold rolled steel sheet, an acid pickling, and a skin pass.

In manufacturing the austenitic stainless steel of the present invention, the preferred manufacturing conditions are as follows.

During the hot rolling, the reheating temperature for the steel slab should be preferably over 1250° C., and more preferably 1250°–1270° C.

The reason is as follows. That is, in the present invention, the Cr content which promotes the high temperature oxidation resistance is lower by 1% compared with the STS 304 steel. Therefore, if the reheating temperature is as high as that for the STS 304 steel (1270°–1290°C.), then the probability of producing the surface defects due to the increase of the high temperature oxidation is very high, and therefore, a low temperature heating (1250°–1270°C.) is required.

Even if the low temperature heating is carried out on the steel slab, the hot rolling deformation resistance is low at the high temperature owing to the 2% addition of Cu, and therefore, there occur no rough band defects which are caused by an excessive deformation resistance during a hot rolling and by the load of the roll or by the roll fatigue.

Further, the annealing temperature for the hot rolled sheet should be preferably 1100°–1180° C., while the annealing temperature for the cold rolled sheet should be preferably 1000°–1150° C.

The annealing conditions for the cold rolled sheet are closely related to the grain size of the final product. In the present invention, the annealing conditions for the cold rolled sheet is controlled in the following manner. That is, the grain size should be preferably same as that of ASTM No. 6.5–10.0, and more preferably ASTM No. 8.0–9.0.

The most satisfactory formability is obtained, when the grains size of the cold rolled sheet after the annealing is same as that of ASTM No. 8.0–9.0. If the grain size becomes cruder than that, then orange peel defects can occur on the surface during the press-forming, while if the grain size is finer than that, the formability is decreased.

Now the present invention will be described based on the actual examples.

EXAMPLE 1

Austenitic stainless steels having the compositions of Table 1 were melted in a vacuum induction melting furnace having a capacity of 50 kg, and then ingots of 25 kg were formed. In the case of the conventional steels C and D, they were heated at 1290° C. for 2 hours, and were hot-rolled, thereby manufacturing hot rolled sheets of 2.5 mm. In the cases of the inventive steels 1 and 2 and the comparative steels A and B, they were heated at 1270° C. for 2 hours, and were hot-rolled, thereby manufacturing hot rolled sheets of 2.5 mm. Then all of them were annealed at a temperature of 1100° C., and then, the hot rolled sheets were acid-pickled. Then they were cold-rolled, thereby manufacturing cold rolled sheets of 0.7 mm. Then they were annealed at a temperature of 1110° C. so as to make the grain size come within the range of ASTM No. 7–8. Then an acid pickling and a skin pass were carried out, thereby manufacturing cold rolled annealed sheets. Then a formability test and a tensile strength test were carried out, and the results are shown in Table 2 below.

Meanwhile, among the steels of Table 1, the ingots of the inventive steel 1 and the comparative steel A were heated at 1270° C. for 2 hours, and the ingot of the conventional steel C was heated at 1290° C. for 2 hours. Then they were hot-rolled into 15 mm sheets, and then, they were processed into gleeble test pieces having a diameter of 10 mm. Then they were evaluated as to the hot workability by using a gleeble testing instrument, and the test results are shown in Table 1 below.

During the hot workability test by using the gleeble test instrument, the temperature was raised at 10° C./sec up to the high temperature testing level, and then, the temperature was maintained for 10 seconds. Then a high temperature tensile strength test was carried out at 30 mm/sec deformation speed. Then the sectional area of the broken test piece was measured so as to calculate the sectional area reduction rate.

TABLE 1

| Test piece | Composition (wt %) C | Si | Mn | P | S | Cr | Ni | Mo | Ti | Cu |
|---|---|---|---|---|---|---|---|---|---|---|
| Inventive 1 | 0.041 | 0.66 | 1.32 | 0.02 | 0.002 | 17.25 | 7.42 | 0.13 | 0.017 | 1.91 |
| 2 | 0.062 | 0.62 | 1.31 | 0.02 | 0.002 | 17.29 | 7.33 | 0.13 | 0.017 | 1.92 |
| Comparative A | 0.042 | 0.61 | 1.28 | 0.02 | 0.001 | 17.43 | 7.32 | 0.13 | — | 1.90 |
| B | 0.066 | 0.63 | 1.27 | 0.02 | 0.002 | 17.56 | 7.35 | 0.13 | — | 1.90 |
| Conventional C | 0.045 | 0.61 | 1.16 | 0.02 | 0.002 | 18.39 | 8.73 | 0.10 | — | 0.20 |
| D | 0.050 | 0.56 | 1.34 | 0.02 | 0.002 | 18.26 | 8.26 | 0.16 | — | 0.21 |

| Test piece | Composition (wt %) Al | B | N | $Md_{30}$* (°C.) | Delta-** ferrite (vol %) | Remarks |
|---|---|---|---|---|---|---|
| Inventive 1 | 0.001 | 0.0028 | 0.0166 | −2.1 | 6.41 | Ti, B |
| 2 | 0.001 | 0.0023 | 0.0228 | −12.6 | 4.12 | Added steel |
| Comparative A | 0.001 | — | 0.0168 | −0.4 | 7.00 | Ti, B |
| B | 0.001 | — | 0.0138 | −12.2 | 5.80 | Non-added steel |
| Conventional C | 0.001 | — | 0.0386 | −15.4 | 6.86 | STS304 |
| D | 0.001 | — | 0.0403 | −4.4 | 6.83 | |

*$Md_{30}$(°C.) = 551−462(C % + N %)—9.2 Si %—8.1 Mn %—29(Ni % + Cu %)—13.8 Cr %—18.5 Mo %—68 Nb %—1.42(ASTM No.-8.0).
**Delta-ferrite(vol %) within the slab = [((Cr % + Mo % + 1.5 Si % + 0.5 Nb % + 18)/(Ni % + 0.52 Cu % + 30 C % + 30 N % + 0.5 Mn % + 36)) + 0.262] × 161—161.

TABLE 2

| Test piece | $Md_{30}$ (°C.) | Thickness (mm) | Formability LDR | Erichsen, mm | CCV, mm | Seasn crckng | Tensile test Yield str (kg/mm²) | Tensile str (kg/mm²) |
|---|---|---|---|---|---|---|---|---|
| Inventive 1 | −2.1 | 0.7 | 2.02 | 12.8 | 26.3 | 3.30 | 26.20 | 63.07 |
| 2 | −12.6 | 0.7 | 1.98 | 13.1 | 26.5 | 2.78 | 26.97 | 63.27 |
| Comparative A | −0.4 | 0.7 | 1.98 | 12.7 | 26.7 | 3.03 | 26.85 | 61.13 |
| B | −12.2 | 0.7 | 1.94 | 13.0 | 26.7 | 2.78 | 26.67 | 60.67 |
| Conventional C | −15.4 | 0.7 | 1.90 | 11.8 | 27.3 | 2.78 | 27.10 | 64.40 |
| D | −4.4 | 0.7 | 1.90 | 12.0 | 27.3 | — | 30.13 | 67.10 |

| Test piece | Tensile test Yield ratio (Y.S/T.S) | Elongtn (%) | Harding exp. 20–10% elongtn | 40–30% elongtn | Hardness (Hv) | Remarks |
|---|---|---|---|---|---|---|
| Inventive 1 | 0.415 | 54.50 | 0.38 | 0.59 | 145 | Ti, B |
| 2 | 0.426 | 55.77 | 0.41 | 0.52 | 154 | Added steel |
| Comparative A | 0.439 | 55.57 | 0.38 | 0.56 | 148 | Ti, B |
| B | 0.440 | 56.37 | 0.39 | 0.51 | 153 | Non-added Steel |
| Conventional C | 0.421 | 54.27 | 0.42 | 0.50 | 170 | STS304 |
| D | 0.449 | 52.67 | 0.39 | 0.50 | 175 | |

1. The limit drawing ratio(LDR) test: a punch diameter <50 mm>, lubricant <Fatty oil>.
2. Erichsen test: based on JIS Z 2247
3. Conical cup test (CCV): based on JIS Z 2249.
4. Season cracking test: Blank diameter variation: <80, 87.5, 95 mm>, punch diameter: <50, 38, 28.8 mm>, season cracking test: <after a multi-step press-forming, the test piece was left in the outer atmosphere, and the limit drawing ratio at which cracks are formed was indicated.
5. Tensile strength test: the test piece size was based on JIS 13B, and the tensile speed was 20 mm/min.

As shown in Table 2 above, the inventive steels 1 and 2 in which Ti and B were added were superior in the limit drawing ratio (LDR), the stretchability (Erichsen) and the composite formability (CCV) compared with the comparative steels A and B and the conventional steels C and D in which Ti and B were not added. In the season cracking resistance, the steels of the present invention showed more than the same level as those of the comparative steels A and B and the conventional steels C and D.

The reason why a tiny amounts of Ti and B improves the formability is that, if Ti which is a ferrite stabilizing element is added, the formation of the strain-induced martensite is increased compared with a non-added steel at the same $Md_{30}$, with the result that the rupture strength and the work hardening exponent n are increased, thereby improving the formability.

Further, the inventive steels 1 and 2 showed a high tensile strength and a low yield ratio (yield strength/tensile strength). Particularly, at the 40–30% elongation region which is the high deformation region, the value of the work hardening exponent n was high, and therefore, ruptures did not occur during the press-forming, with the result that the formability was improved.

Further, the inventive steels 1 and 2 and the comparative steels A and B which contained Cu were low in the yield strength compared with the conventional steels C and D. Further, they could be easily press-formed in the initial stage of the press-forming because the work hardening exponent n was low in the low deformation region of 20–10% elongation range, while in the later stage, the local necking could be prevented so as to improve the formability, because the work hardening exponent n becomes high in the high deformation region of 40–30% elongation range.

Meanwhile, as shown in FIG. 1, the inventive steel 1 is far excellent in the hot workability compared with the comparative steel A, and is same in the hot workability as that of the conventional steel D.

The reason why the addition of Ti and B improves the hot workability as in the case of the inventive steel 1 is as follows. That is, if Cu which is a low melting point element is added, the grain boundary bonding strength is lowered during a high temperature heating as in the case of heating the ingot to a temperature of 1290° C. However, if a tiny amount of Ti is added, the grains at the high temperature is made fine, as well as preventing the grain boundary oxidation. Further, Ti is bonded with N in the melt, so that the content of N which lowers the hot workability would be reduced. When B is added together with Ti, B is segregated on the grain boundary so as to inhibit the cavitation of the grain boundary and so as to delay the decohesion of the grain boundary. Further, in a solid solution state, the interaction between B and the vacancy improves the hot workability.

EXAMPLE 2

Austenitic stainless steels having the compositions of Table 3 below were melted in a vacuum induction melting furnace having a capacity of 50 kg so as to manufacture ingots of 25 kg. Then the ingots were heated at a temperature of 1270° C. for 2 hours, and then, a hot rolling was carried out to manufacture hot rolled sheets of 2.5 mm. Then they were annealed at a temperature of 1100° C., and then, an acid-wash was carried out. Then test pieces for a thermogravimetric analysis (TGA) were prepared to carry out the TGA, and the results are shown in FIG. 2.

In carrying out the TGA, the testing atmosphere was a mixture of gases (cokes oven gas plus blast furnace gas) (C.O.G.+B. F. G.), and the excess oxygen volume ratio was 3%, while the oxidation testing temperature was 1260° C.

Figure 2:
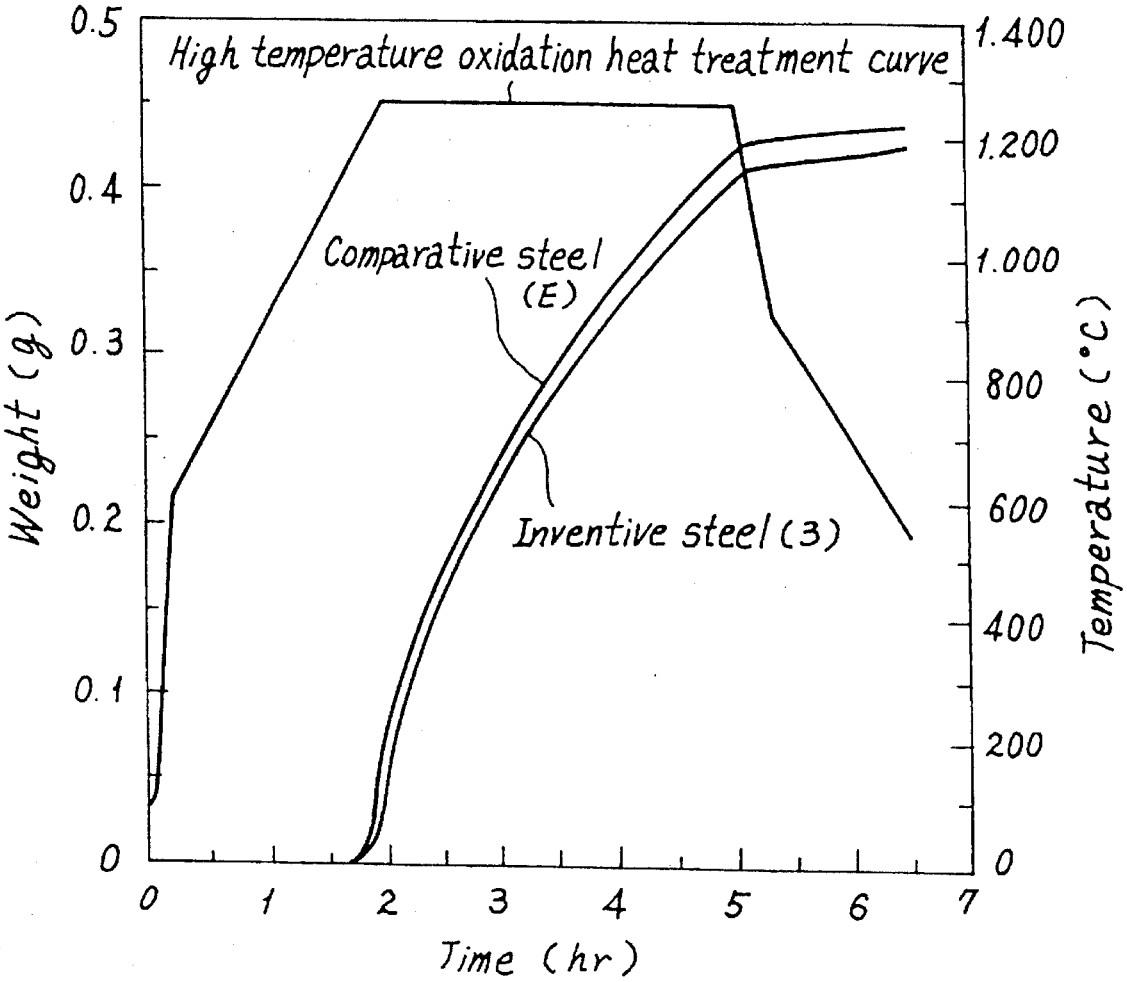
FIG. 2 illustrates the variation of the weight gain (due to the high temperature oxidation) versus heating time at 1260° C.

As shown in FIG. 2, the inventive steel 3 was superior in the high temperature oxidation resistance compared with the comparative steel E. The reason is not that Ti is concentrated within the scales to enhance the oxidation resistance, but that the oxygen existing on the grain boundary is prevented from being moved into the base metal.

EXAMPLE 3

Figure 4:
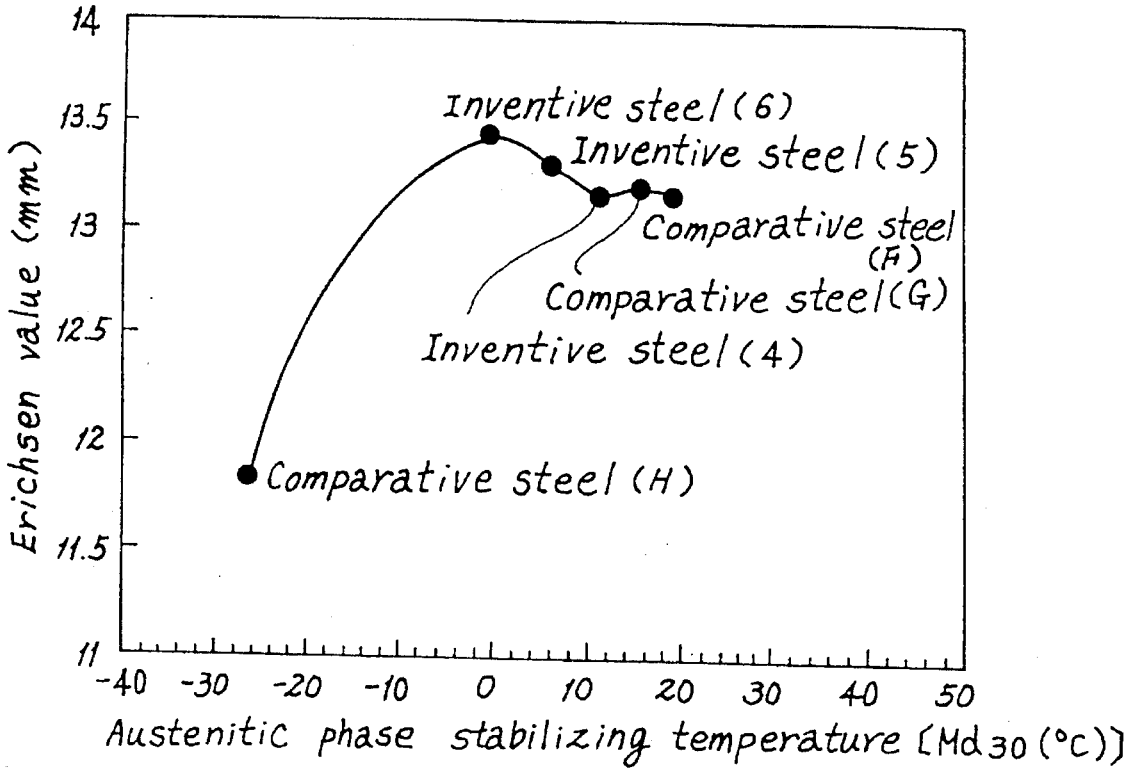
FIG. 4 is a graphical illustration showing the Erichsen value versus the variation of the stabilizing temperature ($Md_{30}$, °C.) for the austenitic phase in a Cu containing steel.
Figure 5:
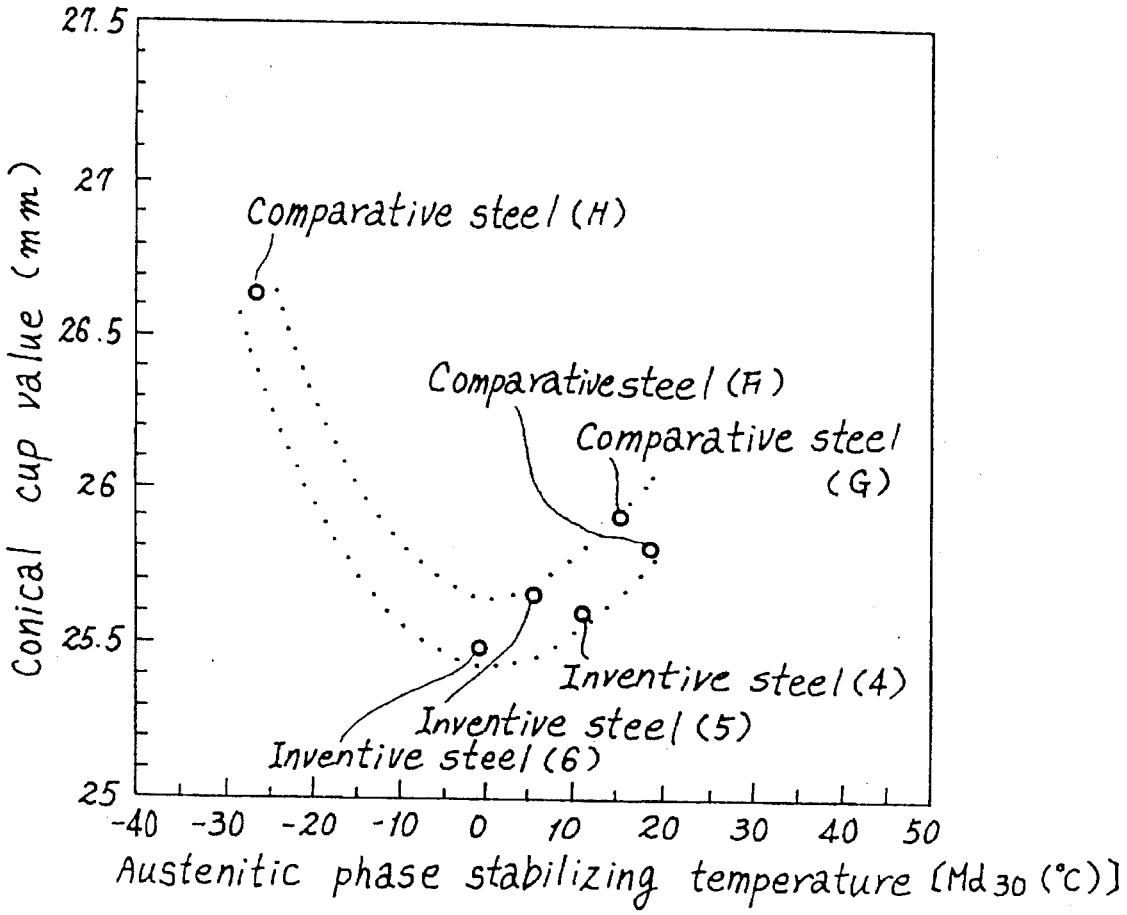
FIG. 5 is a graphical illustration showing the variation of the conical cup value (CCV) versus the variation of the stabilizing temperature ($Md_{30}$, °C.) for the austenitic phase in a Cu containing steel.

Austenitic stainless steels having the compositions of Table 4 below were melted in a vacuum induction furnace having a capacity of 30 kg so as to manufacture ingots. Then they were heated at 1260° C. for 2 hours, and then, they were hot-rolled into 2.5 mm. Then an annealing was carried out at 1110° C. so as to prepare hot rolled annealed sheets. Then they were acid-pickled, and then, were cold-rolled into a thickness of 0.5 mm. Then an annealing was carried out at a temperature of 1110° C., thereby manufacturing cold rolled annealed steel sheets. Then they were acid-pickled, and then, a skin pass was carried out. Then they were subjected to a formability test, and the results are shown in FIGS. 3 to 5.

Figure 3:
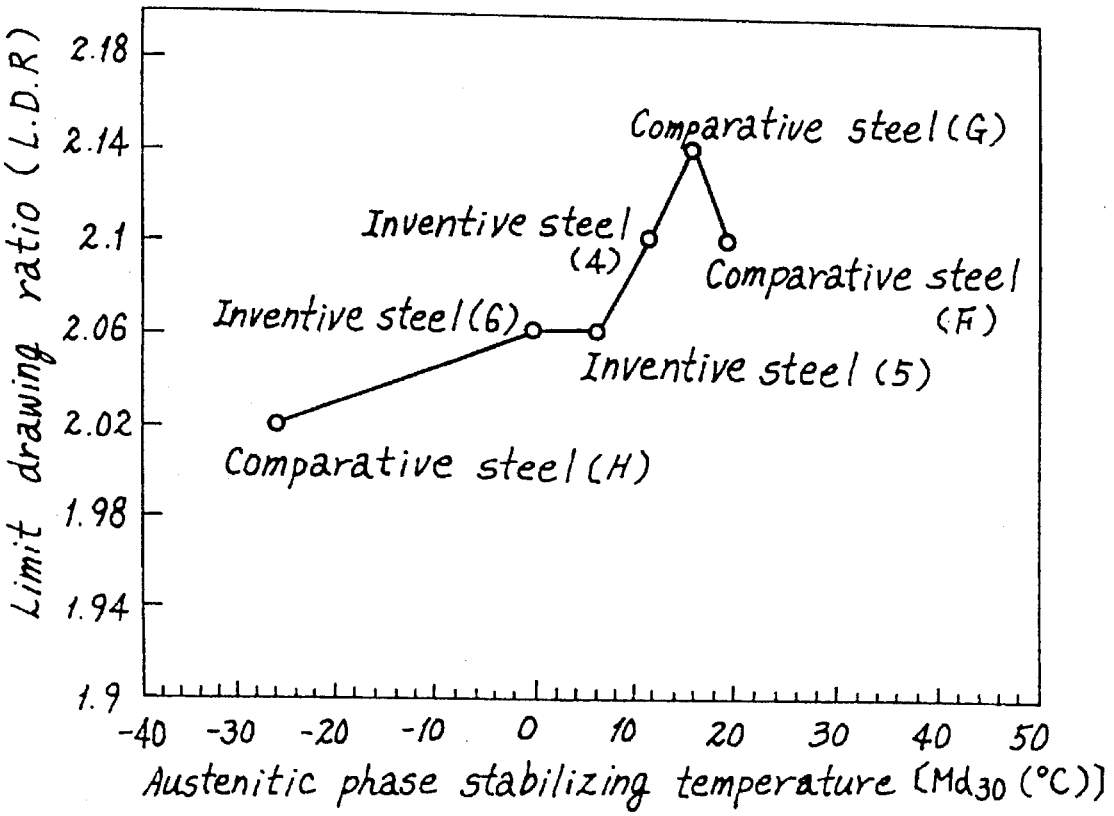
FIG. 3 is a graphical illustration showing the values of the limit drawing ratio (LDR) versus the variation of the austenitic phase stabilizing temperature [$Md_{30}$, (°C.); the temperature at which 50% of a strain-induced martensitic phase ($\alpha'$) are produced under the action of a true strain of 0.3] in a Cu containing steel.

That is, FIG. 3 illustrates the variation of the limit drawing ratio (LDR) versus the variation of the stabilizing temperature [$Md_{30}$(°C.)] for the austenitic phase. FIG. 4 illustrates the variation of the Erichsen value, and FIG. 5 illustrates the variation of the conical cup value (CCV).

TABLE 3

| | Chemical composition (wt %) | | | | | | | | | | | | | $Md_{30}$* |
|---|---|---|---|---|---|---|---|---|---|---|---|---|---|---|
| Test piece | C | Si | Mn | P | S | Cr | Ni | Mo | Ti | Cu | Al | B | N | (°C.) |
| Inventive 3 | 0.060 | 0.64 | 1.33 | 0.02 | 0.02 | 17.15 | 7.37 | 0.13 | 0.019 | 1.95 | 0.002 | 0.0014 | 0.0195 | −10.9 |
| Comparative E | 0.052 | 0.62 | 1.31 | 0.02 | 0.01 | 17.15 | 7.37 | 0.13 | — | 1.92 | 0.001 | — | 0.0135 | −1.9 |

*$Md_{30}$ is same that which is presented in Table 1 of Example 1.

TABLE 4

| Test piece | Chemical composition (wt %) | | | | | | | | | | | | | $Md_{30}$* |
|---|---|---|---|---|---|---|---|---|---|---|---|---|---|---|
| | C | Si | Mn | P | S | Cr | Ni | Mo | Ti | Cu | Al | B | N | (°C.) |
| Comparative F | 0.054 | 0.55 | 1.25 | 0.02 | 0.02 | 16.84 | 6.79 | 0.20 | 0.017 | 1.90 | 0.001 | 0.0023 | 0.0167 | 18.72 |
| G | 0.060 | 0.51 | 1.54 | 0.02 | 0.02 | 17.16 | 6.61 | 0.20 | 0.017 | 1.91 | 0.001 | 0.0022 | 0.0191 | 15.27 |
| Inventive 4 | 0.055 | 0.62 | 1.23 | 0.02 | 0.02 | 16.58 | 7.10 | 0.19 | 0.017 | 1.90 | 0.001 | 0.0024 | 0.0190 | 11.05 |
| 5 | 0.068 | 0.54 | 1.28 | 0.02 | 0.01 | 16.97 | 6.47 | 0.20 | 0.017 | 1.96 | 0.001 | 0.0022 | 0.0417 | 5.75 |
| 6 | 0.057 | 0.58 | 1.24 | 0.02 | 0.02 | 16.58 | 7.59 | 0.20 | 0.017 | 1.90 | 0.001 | 0.0023 | 0.0125 | −0.7 |
| Comparative H | 0.063 | 0.52 | 1.26 | 0.02 | 0.01 | 16.93 | 8.10 | 0.20 | 0.017 | 1.91 | 0.001 | 0.0022 | 0.0197 | −26.4 |

*$Md_{30}$(°C.) = 551−462(C % + N %)—9.2 Si %—8.1 Mn %—29(Ni % + Cu %)—13.8 Cr %—18.5 Mo %—68 Nb %—1.42(ASTM grain No.-8.0).

As shown in FIG. 3, If the $Md_{30}$ is raised, the limit drawing ratio is increased, then the maximum value is attained at $Md_{30}$=+15° C., and then, the value is decreased.

Further, as shown in FIG. 4, if the temperature $Md_{30}$ rises, the Erichsen value which shows the stretch ability increases. At the point where the temperature $Md_{30}$ is 0° C., the Erichsen value shows the maximum level, and thereafter, the Erichsen value gradually drops.

Further, as shown in FIG. 5, if the temperature $Md_{30}$ rises, the conical cup value (CCV) which indicates the composite formability shows the minimum level at the point where the temperature $Md_{30}$ is 0° C., and thus, shows that the composite formability is most superior at the point. Thereafter, the conical cup value increases, thereby showing that the composite formability is aggravated.

Based on the results, it is found that, in the Cu added steel, the most superior formability (such as deep drawability, stretchability and composite formability) and season cracking resistance are obtained in the temperature $Md_{30}$range of −10° to +15° C.

EXAMPLE 4

Austenitic steels having the compositions of Table 5 were melted in a vacuum induction furnace having a capacity of 30 kg so as to manufacture ingots. In the case of the inventive steel 7, a heating was carried out at a temperature of 1260° C. for 2 hours, while in the case of the comparative steel I, a heating was carried out at a temperature of 1290° C. for 2 hours. Then in both of them, a hot rolling was carried out into 2.5 mm, and then, an annealing was carried out at 1110° C. Then an acid pickling was carried out, and then, a cold rolling was carried out into 0.7 mm cold rolled sheets. Then annealings were carried out with variation of the annealing time. Then the LDR and Erichsen value versus the variation of the grain sizes were tested, and the results are shown in FIG. 6.

TABLE 5

| Test piece | Chemical composition (wt %) | | | | | | | | | | | | | $Md_{30}$ °C. |
|---|---|---|---|---|---|---|---|---|---|---|---|---|---|---|
| | C | Si | Mn | P | S | Cr | Ni | Mo | Ti | Cu | Al | B | N | |
| Inventive 7 | 0.042 | 0.65 | 1.31 | 0.021 | 0.001 | 16.68 | 7.65 | 0.05 | 0.014 | 2.01 | 0.002 | 0.0020 | 0.0134 | −1.48 |
| Conventional I | 0.049 | 0.53 | 1.04 | 0.026 | 0.003 | 18.15 | 8.57 | 0.10 | 0.014 | 0.20 | 0.001 | 0.0027 | 0.0427 | −8.05 |

Figure 6:
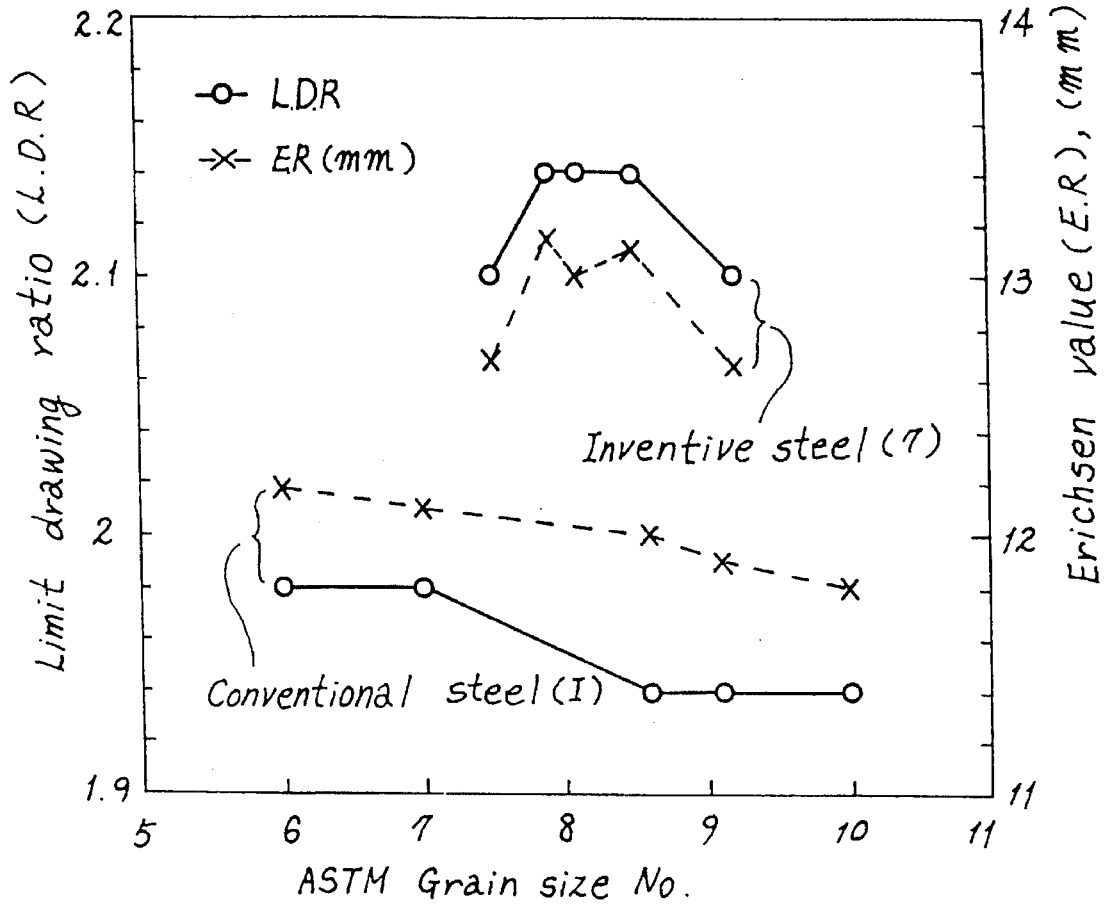
FIG. 6 is a graphical illustration showing the variation of the formability versus the variation of the grain size in a cold rolled annealed sheets.

As shown in FIG. 6, the inventive steel 7 showed a superior formability compared with the conventional steel I, and the formability was most superior in the grain size range of ASTM 8–9.

In the case of the conventional steel I (STS 304), as the grain size becomes larger, the formability is slightly improved. However, if the grain size was made to be coarser to below ASTM No. 7, an orange peel defect occurred on the surface of the press-formed products.

What is claimed is:

1. An austenitic stainless steel having superior press formability, season cracking resistance, hot workability and high temperature oxidation resistance, comprising in weight %: less than 0.07% of C, less than 1.0% of Si, less than 2.0% of Mn, 16–18% of Cr, 6.0–8.0% of Ni, less than 0.005 % of Al, less than 0.05 % of P, less than 0.005 % of S, less than 0.03 % of Ti, less than 0.003 % of B, less than 3.0% of Cu, less than 0.3 % of Mo, less than 0.1% of Nb, less than 0.045% of N, the balance of Fe and other incidental impurities, said steel further having an austenitic phase stabilizing temperature $Md_{30}$ (°C.) within the range of −10° to+15° C.; and having a delta-ferrite content of less than 9.0 vol %, where said stabilizing temperature is defined by the formula: $Md_{30}$ (°C.)=551−462 (C % N %)−9.2 Si %−8.1 Mn %−29 (Ni %+Cu %)−13.8 Cr %−18.5 Mo %−68 Nb %−1.42 (ASTM grain No.—8.0).

2. An austenitic stainless steel having superior press formability, season cracking resistance, hot workability and high temperature oxidation resistance, comprising in weight %: less than 0.07% of C, less than 1.0% of Si, less than 2.0% of Mn, 16–18% of Cr, 6.0–8.0% of Ni, less than 0.005 % of Al, less than 0.05 % of P, less than 0.005 % of S, less than 0.03 % of Ti, less than 0.003 % of B, less than 3.0% of Cu, less than 0.3 % of Mo, less than 0.1% of Nb, less than 0.045% of N, the balance of Fe, and other incidental impurities and having a grain size within the range of ASTM No. 6.5–10.0.

3. An austenitic stainless steel having superior press formability, season cracking resistance, hot workability and high temperature oxidation resistance, comprising in weight %: less than 0.07% of C, less than 1.0% of Si, less than 2.0% of Mn, 16–18% of Cr, 6.0–8.0% of Ni, less than 0.005 % of Al, less than 0.05 % of P, less than 0.005 % of S, less than 0.03 % of Ti, less than 0.003 % of B, less than 3.0% of Cu, less than 0.3 % of Mo, less than 0.1% of Nb, less than 0.045% of N, the balance of Fe and other incidental impurities, said steel further having an austenitic phase stabilizing temperature $Md_{30}$(°C.) within the range of −10° to+15° C.;

and having a delta-ferrite content of less than 9.0 vol %, where said stabilizing temperature is defined by the formula: $Md_{30}$(°C.)=551–462 (C % N %)–9.2 Si %–8.1 Mn %–29 (Ni %+Cu %)–13.8 Cr %–18.5 Mo %–68 Nb %–1.42 (ASTM grain No.—8.0) and having a grain size within the range of ASTM No. 6.5–10.0.

4. The austenitic stainless steel as claim in claim 2, wherein the grain size comes Within the range of ASTM No. 8.0–9.0.

5. A process for manufacturing an austenitic stainless steel having superior press formability, season cracking resistance, hot workability, and high temperature oxidation resistance, comprising the steps of:

preparing a steel slab composed of in weight %: less than 0.07% of C, less than 1.0% of Si, less than 2.0% of Mn, 16–18% of Cr, 6.0–8.0% of Ni, less than 0.005% of Al, less than 0.05% of P, less than 0.005% of S, less than 0.03% of Ti, less than 0.003% of B, less than 3.0% of Cu, less than 0.3% of Mo, less than 0.1% of Nb, less than 0.045% of N, the balance of Fe, and other indispensable impurities;

heating said steel slab to 1250°–1270° C. to carry out a hot rolling;

carrying out an annealing at a temperature of 1100°–1180° C.;

carrying out an acid-wash;

carrying out a cold rolling;

carrying out an annealing so as to make the grain size of the cold rolled sheet come within the range of ASTM No. 6.5–10.0; and carrying out an acid pickling and carrying out a skin pass.

6. The process as claimed in claim 5, wherein an austenitic phase stabilizing temperature [$Md_{30}$(°C.)] comes within the range of −10° to +15° C.; and the content of the delta-ferrite is 9.0 vol %, where said stabilizing temperature is defined by "$Md_{30}$ (°C.)=551–462 (C %+N %)–9.2Si %–8.1Mn %–29 (Ni %+Cu %)–13.8Cr %–18.5 Mo %–68Nb %–1.42 (ASTM grain No.—8.0)".

7. The process as claimed in claim 5, wherein said annealing for said cold rolled sheet is carried out in such a manner that the grain size of the cold rolled sheet should come within the range of ASTM No. 8.0–9.0.

8. The austenitic stainless steel as claim in claim 3 wherein the grain size comes within the range of ASTM No. 8.0–9.0.

9. The process as claimed in claim 6, wherein said annealing for said cold rolled sheet is carried out in such a manner that the grain size of the cold rolled sheet should come within the range of ASTM No. 8.0–9.0.

* * * * *

UNITED STATES PATENT AND TRADEMARK OFFICE

CERTIFICATE OF CORRECTION

PATENT NO. : 5,571,343

DATED : November 5, 1996

INVENTOR(S) : Do Y. Ryoo, Yong H. Lee, Jae S. Park, Hyun C. Kim and Eung J. Kim

It is certified that error appears in the above-indentified patent and that said Letters Patent is hereby corrected as shown below:

Title page, delete "[22] Filed: Apr. 19, 1995" and insert

--[22] PCT Filed: Aug. 24, 1994
[86] PCT No.: PCT/KR94/00114
§ 371 Date: Apr. 19, 1995
§ 102(e) Date: Apr. 19, 1995
[87] PCT Pub. No.: WO95/06142
PCT Pub. Date: Mar. 2, 1995--.

Column 1 Line 67 "302975." should read --1302975.--.

Claim 1 Line 33 Column 12 before "N %)" insert --+--.

Claim 3 Line 3 Column 13 before "N %)" insert --+--.

Claim 4 Line 8 Column 13 "Within" should read --within--.

Claim 8 Line 19 Column 14 after "3" insert --,--.

Signed and Sealed this

Sixth Day of October, 1998

*Attest:*

*Attesting Officer*

BRUCE LEHMAN

*Commissioner of Patents and Trademarks*